US010546493B2

(12) United States Patent
Franco et al.

(10) Patent No.: US 10,546,493 B2
(45) **Date of Patent: *Jan. 28, 2020**

(54) COGNITIVE TRAFFIC SIGNAL CYCLE TIMER

(71) Applicant: International Business Machines Corporation, Armonk, NY (US)

(72) Inventors: Diego P. R. Franco, Belo Horiozonte (BR); Fernando A. Cavalcanti, Belo Horizonte (BR); Marcos C. Sylos, Ribeirao Preto (BR)

(73) Assignee: Internationl Business Machines Corporation, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/200,792

(22) Filed: Nov. 27, 2018

(65) Prior Publication Data

US 2019/0340923 A1 Nov. 7, 2019

Related U.S. Application Data

(63) Continuation of application No. 15/972,261, filed on May 7, 2018, now Pat. No. 10,210,755.

(51) Int. Cl.

| | |
|---|---|
| ***G08G 1/083*** | (2006.01) |
| ***G08G 1/01*** | (2006.01) |
| ***G08G 1/082*** | (2006.01) |

(52) U.S. Cl.

CPC ..... *G08G 1/083* (2013.01); *G08G 1/0112* (2013.01); *G08G 1/082* (2013.01)

(58) Field of Classification Search

CPC ..... G08G 1/083; G08G 1/0112; G08G 1/082

USPC ..... 340/920

See application file for complete search history.

(56) References Cited

U.S. PATENT DOCUMENTS

| | | | |
|---|---|---|---|
| 8,212,688 | B2 | 7/2012 | Morioka et al. |
| 9,633,560 | B1 | 4/2017 | Gao et al. |
| 9,805,595 | B1 | 10/2017 | Liebinger Portela et al. |
| 2002/0005790 | A1 | 1/2002 | Georgalis |
| 2002/0077742 | A1 | 6/2002 | Mintz |

(Continued)

FOREIGN PATENT DOCUMENTS

| | | |
|---|---|---|
| CN | 106297342 A | 1/2017 |
| CN | 206147953 U | 5/2017 |

OTHER PUBLICATIONS

"Geospatial Analytics", IBM Cloud, printed Feb. 28, 2018, 1 page. https://console.bluemix.net/catalog/services/geospatial-analytics.

(Continued)

*Primary Examiner* — Nay Tun

(74) *Attorney, Agent, or Firm* — Scott S. Dobson

(57) ABSTRACT

A self-learning cycle timer is disclosed. A wait time is measured between a first indication, associated with a stop, and a second indication, associated with movement following the stop, each indication received from a smart device. A geolocation is received from the smart device and a traffic signal identified at the geolocation. The traffic signal's area of influence is determined. The wait time is determined to have occurred inside the area of influence. An average cycle time and a reference time associated with the traffic signal are retrieved from a database. A cycle time associated with the traffic signal is calculated according to the wait time and the reference time. The average cycle time is updated according to the calculated cycle time.

20 Claims, 6 Drawing Sheets

(56) References Cited

U.S. PATENT DOCUMENTS

| | | | |
|---|---|---|---|
| 2002/0082767 | A1 | 6/2002 | Mintz |
| 2009/0292456 | A1 | 11/2009 | Inoguchi et al. |
| 2011/0320111 | A1 | 12/2011 | Sarma et al. |
| 2012/0065871 | A1 | 3/2012 | Deshpande et al. |
| 2012/0326890 | A1 | 12/2012 | Cross |
| 2015/0330794 | A1 | 11/2015 | Fuehrer |
| 2016/0098924 | A1 | 4/2016 | Vahidi et al. |
| 2017/0197617 | A1 | 7/2017 | Penilla et al. |
| 2017/0270785 | A1 | 9/2017 | Umehara |
| 2017/0292849 | A1 | 10/2017 | Fino |
| 2017/0330456 | A1 | 11/2017 | Miller et al. |

OTHER PUBLICATIONS

Alexander, "Watson Analytics expands its reach with geospatial analysis", IBM, Business Analytics Blog, Aug. 10, 2016, 5 pages. https://www.ibm.com/blogs/business-analytics/geospatial-analysis/.

Robinson, "Audi is adding a traffic light timer to the dashboard so you know how long you can text", Business Insider, Aug. 15, 2016, 5 pages. http://www.businessinsider.com/audi-traffic-light-countdown-timer-2016-8.

Franco et al., "Cognitive Traffic Signal Cycle Timer", U.S. Appl. No. 15/972,261, filed May 7, 2018.

List of IBM Patents or Patent Applications Treated as Related, dated Nov. 26, 2018, pp. 1-2.

COGNITIVE TRAFFIC SIGNAL CYCLE TIMER

BACKGROUND

The present disclosure relates to a self-learning timer, and more specifically, to the application of a self-learning timer to traffic signals. Traffic signals are widely employed to regulate complex traffic patterns and provide assistance in locations where intersecting traffic patterns require driver interactions. Traffic signals generally act by directing some portion of the traffic to stop and wait, allowing an intersecting portion of traffic to safely proceed without collision. So-called "smart" traffic signals provide countdown timers for to notify travelers of how much time they have remaining in the signal's cycle to traverse a "go" signal, how long they can expect to wait at a "stop" signal, etc.

SUMMARY

According to embodiments of the present disclosure, a method for a self-learning cycle timer is disclosed. The method comprises determining a wait time, the wait time being a time elapsed between a first indication and a second indication, each received from a smart device associated with a traveler. The first indication is associated with the traveler coming to a stop and the second indication is associated with the traveler beginning to move following the stop. A geolocation is received from the smart device and a traffic signal associated with the geolocation is identified.

An area of influence associated with the traffic signal is determined which establishes a distance from the traffic signal within which the traveler may be expected to be interacting with the traffic signal. The wait time is determined to have occurred inside the area of influence.

An average cycle time and a reference time, each associated with the traffic signal, are retrieved from a database or a memory. A cycle time associated with the traffic signal is calculated according to the wait time and the reference time. The average cycle time is updated according to the calculated cycle time.

A computing system and computer program product can embody the method and structures of the disclosure. The computing system can comprise a network, a memory configured to store the average cycle time and the reference time, and a processor in communication with the memory. The computing system can be configured to perform the method.

The above summary is not intended to describe each illustrated embodiment or every implementation of the present disclosure.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
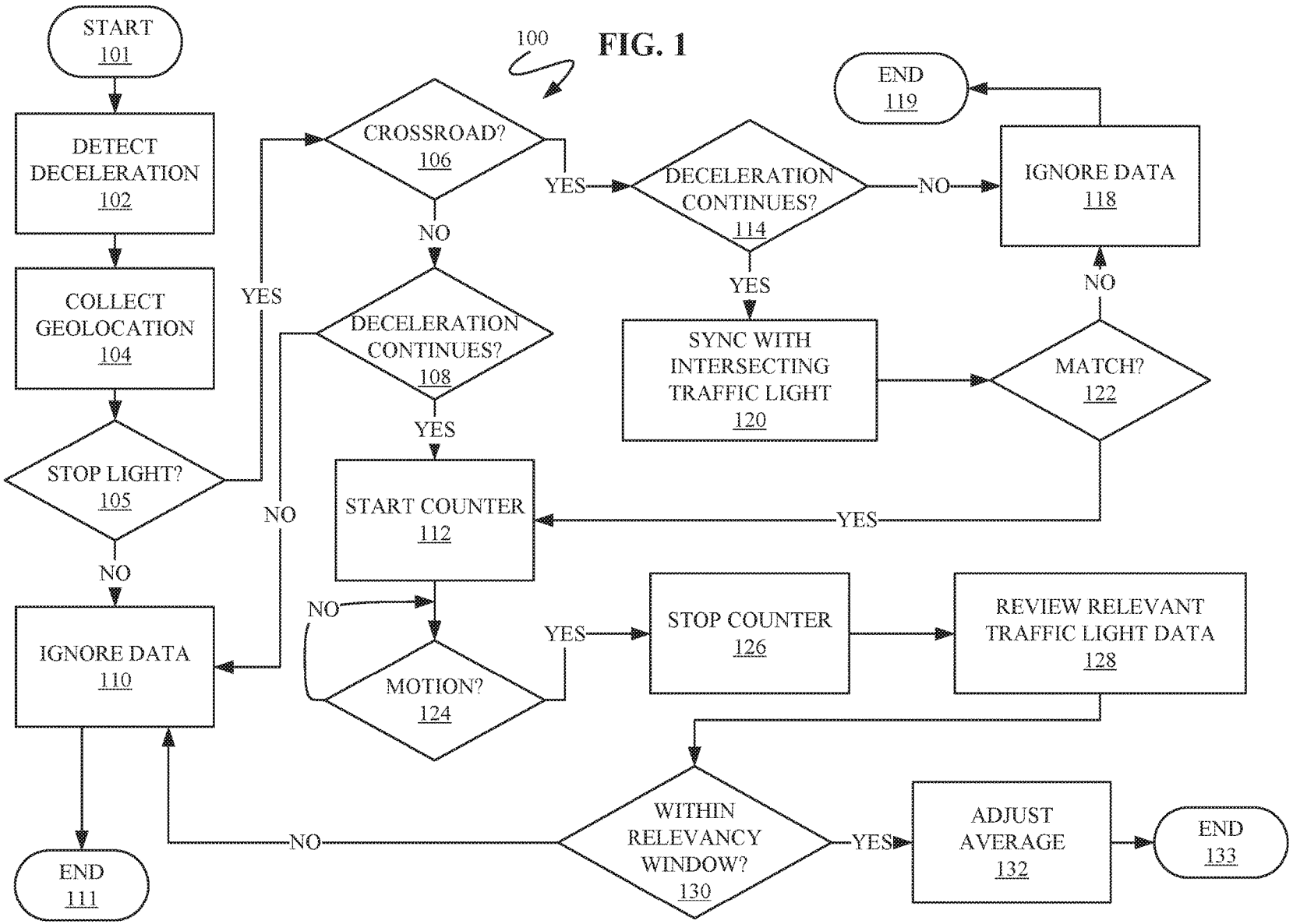
FIG. 1 depicts a flow diagram of an example method of using travelers' smart devices to determine a traffic signal's cycle time, according to embodiments of the present disclosure.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

Aspects of the present disclosure relate to a self-learning timer, and more particular aspects relate to the application of a self-learning timer to traffic signals. While the present disclosure is not necessarily limited to such applications, various aspects of the disclosure may be appreciated through a discussion of various examples using this context.

A significant obstacle to efficient route planning is predicting the effect traffic signals will have on the ultimate travel time. This obstacle can be mitigated by so called "smart" traffic signals, which provide cycle times or countdown timers to drivers to indicate when the signal will change again, but transitioning all traffic signals from traditional models to smart traffic signals with displayed timers would be an onerous and expensive infrastructure shift.

Disclosed herein is a method and system to utilize travelers' existing smart devices (e.g. phones, tablets, watches, cars, etc.) to determine the cycle times of traffic signals and thus make the signals functionally "smart" without any costly changes to a city's infrastructure. By utilizing travelers' existing smart devices to measure the time spent at each traffic signal, the cycle time of signals may be calculated. Using the calculated cycle time of the traffic signals, the fastest route accounting for time spent at signals may be determined for individual travelers. Additionally, a system with this information available may have numerous other capabilities such as, for example, the ability to advise drivers when to accelerate and when to brake when approaching a traffic signal.

Disclosed herein is a method and system for a self-learning timer to determine and utilize traffic signal cycle times. A wait time for a traveler at a traffic signal, or the amount of time the traveler remains stopped due to interacting with the traffic signal's "stop" signal, is determined according to a stop indication and a move indication received from a smart device associated with the traveler. A traveler, as discussed herein, may refer to a user or vehicle transporting a smart device. In embodiments, the traveler and the smart device may be separate and distinct, e.g., a user carrying a smart phone, or may be a single entity, e.g., a smart car. A geolocation, e.g., the traveler's longitude and latitude, may additionally be received from the smart device and a traffic signal associated with the geolocation identified. An area of influence associated with the traffic signal may be determined according to past or concurrent data, or may be stored data associated with the traffic signal as identified. The wait time may be verified to have occurred inside the area of influence. A cycle time associated with the traffic signal is calculated according to the wait time and a plurality of other wait times previously or concurrently associated with the traffic signal.

Referring now to FIG. 1, a flow diagram of an example method 100 for leveraging traveler's smart devices to determine a traffic signal's cycle time is depicted, according to embodiments of the present disclosure. In embodiments, the method 100 may be executed by an application present on the smart device or by one or more processors which may, for example, function as part of a remote server or cloud. The method may begin at operation 101 in a monitoring or "listening" state, e.g., the system may be actively scanning and detecting the smart devices of travelers to determine when they are decelerating in the vicinity of a traffic signal, or the system may be in a hold state waiting to receive a communication from a traveling smart device.

Using an integrated or accessed gyroscope, global positioning system, accelerometer, etc., a smart device detects when it is in motion or stopped, and may further detect when it is decelerating. The disclosed system may receive a deceleration indication from a traveler's smart device, as at operation 102, and initiate to evaluate and update a traffic signal's cycle time, if the traffic signal is determined to be associated with the traveler's decreasing speed. In embodiments, the system may detect a decelerating traveler by monitoring smart devices or areas around traffic signals, e.g., by video, or may be in a standby mode awaiting a deceleration indication to be received from a traveler's smart device.

At operation 104, the system may collect or receive the smart device's geolocation, e.g., a set of coordinates, such as latitude and longitude, intersecting streets at an intersection, coordinates corresponding to a city (or county or state or other) grid, etc. It is to be understood that the step of the method 100 may be performed in any order and that some may even be performed in parallel. For example, although FIG. 1 depicts the geolocation be collected subsequent to the detection of a deceleration, the geolocation could be received concurrently with the deceleration indication or, in embodiments wherein the system monitors for deceleration in the vicinity of a traffic signal, the geolocation data would be collected as the monitoring location before a deceleration is detected.

Using the geolocation data and, in embodiments, city and other map data, the system determines whether a traffic signal is associated with the smart device's deceleration, as at decision block 105. If the system determines a traffic signal is not associated with the smart device's geolocation, and therefore not associated with the detected deceleration, the data may be ignored, as at operation 110. If the data is to be ignored, the method may end, as at operation 111, allowing to system to resume a monitoring or standby state.

If the system, at decision block 105, determines that a traffic signal is associated with the smart device's geolocation, it may proceed to determine, as at decision block 106, whether a crossroad or otherwise intersecting traffic signal is associated with the smart device's geolocation (e.g., there may be multiple traffic signals to consider). If it is determined that the deceleration is not occurring at a crossroad, the system may verify that the traveler is continuing to decelerate (rather than maintaining a reduced speed, accelerating after passing an obstacle, etc.), as at decision block 108. If the system verifies that the smart device, and associated traveler, are not continuing to decelerate, the data may be ignored, as at operation 110. If the data is to be ignored, the method may end, as at operation 111, allowing to system to resume a monitoring or standby state.

If the system determines that the traveler is in fact continuing to decelerate, at decision block 108, the system determines that the traveler is stopping at a traffic signal, and starts a counter to time the relevant traffic signal's wait time, as at operation 112.

If the system, at decision block 106, determines that the traveler is at a crossroad, the system may then verify if the smart device, and its associated traveler, is continuing to decelerate, as at decision block 114. If the system determines that the traveler has not continued to decelerate, e.g., maintains a new lower speed or transitions to accelerating, it may ignore the data associated with deceleration indication, as at operation 118. If the data is to be ignored, the method may end, as at operation 119, allowing to system to resume a monitoring or standby state.

If the system determines that the traveler has continued to decelerate, at decision block 114, it may sync with data associated with an intersecting traffic signal, as at operation 120. Data associated with the intersecting traffic signal may include stored cycle time data, current video or traveler movement data, etc. Once synced with the intersecting traffic signal, the system may determine whether the current data received matches the data associated with the intersecting traffic signal, as at decision block 122. If the data is not found to match, it may be ignored, as at operation 118. If the data is to be ignored, the method may end, as at operation 119, allowing to system to resume a monitoring or standby state.

If the data is found to match, a counter may be started to record the wait time, as at operation 112. A match may vary according to adjustable system settings but, for example, may consist of verifying that traffic is flowing through an intersecting traffic signal, comparing cycle times to verify crossing lanes of traffic do not move at the same time, etc.

While the wait time counter is active, the system may enter a monitoring loop to determine when the smart device begins moving again, as at decision block 124. If the system does not detect motion, the monitoring loop may be maintained. If motion is detected, the system may stop the wait time counter, as at operation 126. The system may validate movement indications, for example, by setting a minimum threshold of movement, e.g., if movement is detected but does not continue for greater than 10 seconds, the traveler may be assumed to still be waiting at the light, and the monitoring loop maintained.

At operation 128, the system may review relevant data associated with the traffic signal, and compare the measured wait time with the reviewed data. Relevant data may include an average wait time associated with the traffic signal, a maximum expected wait time associated with the traffic signal (e.g., wait times in excess of the maximum expected wait time may be assumed to be in response something more/other than the traffic signal giving a stop signal and accordingly discarded), etc.

The system may determine whether the measured wait time lies within a predetermined relevancy window, as at decision block 130. The relevancy window may be set according to predetermined values, e.g. +/−10% of the average wait time. If the wait time is determined to be outside of the relevancy window, the data may be determined to be an outlier and be dismissed or ignored, as at operation 110. For example, wait times in excess of the relevancy window may be attributed to an accident disrupting traffic or the traveler experiencing vehicle trouble. Wait times less than the relevancy window may be attributed to an obstacle in the road. In both cases (greater than or less than the relevancy window), the collected wait time is not related to the traffic signal's cycle time and is discarded to prevent the average from being distorted. If the data is to be ignored, the method may end, as at operation 111, allowing to system to resume a monitoring or standby state.

If the wait time is determined to be inside of the relevancy window, and thus not an outlier, an average wait time associated with the traffic signal may be adjusted, as at operation 132. The method may then end, as at operation 133, the system may proceed to evaluate another declaration indication or resume a monitoring and/or standby state.

Figure 2A:
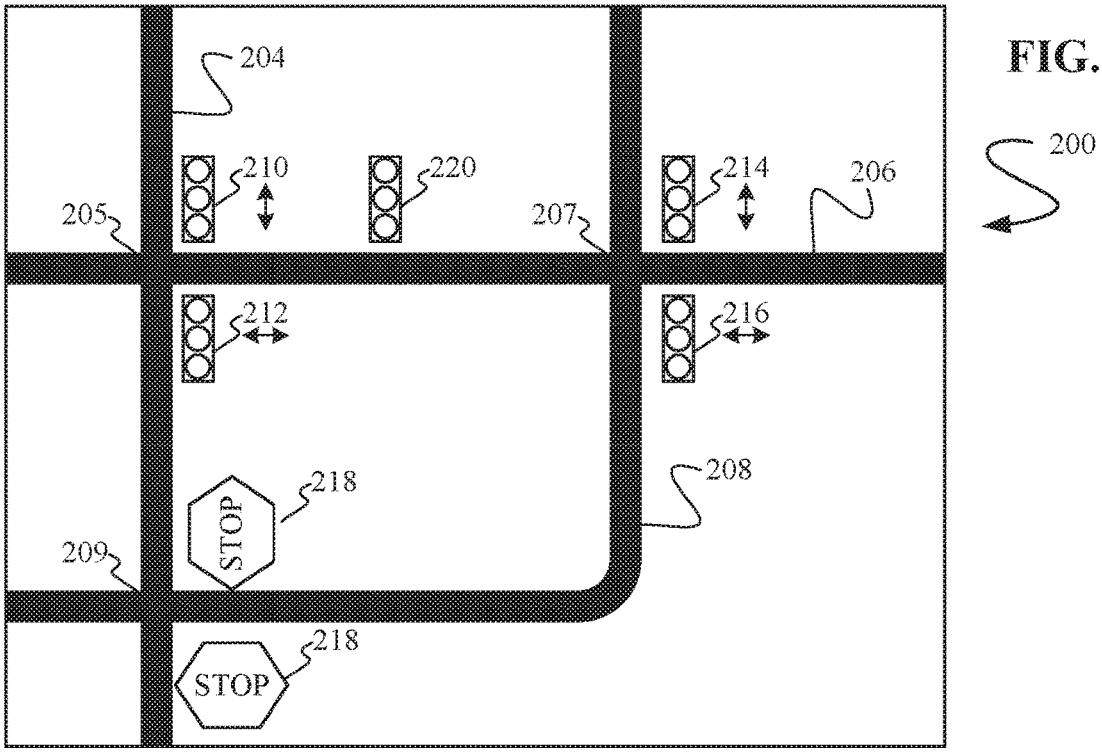
FIG. 2A depicts a map of intersections controlled by traffic signals, according to embodiments of the present disclosure.

Referring now to FIG. 2A, a map 200 of intersections controlled by traffic signals is depicted, according to embodiments of the present disclosure. Map 200 presents intersecting roads 204, 206, and 208. The flow of traffic at the intersection of the roads 204, 206, 208 may be controlled by traffic signals, such as traffic signals 210, 212 at intersection 205 and traffic signals 214, 216 at intersection 207, or fixed signals, such as stop signs 218 at intersection 209. Intersections controlled by traffic signals 205, 207 may be differentiated from intersections controlled by fixed signals 209 according to map or city planning data retrieved or stored by the system, or may be determined according to the pattern of deceleration and wait time data calculated from travelers' smart devices. For example, city planning data may indicate that stop signs are present at a particular intersection, or may simply indicate that a variable traffic signal is not present at the particular intersection. The system may also, or alternatively, use a set of predetermined criteria to determine whether a traveler is interacting with a stop sign. For example, criteria may include a minimum threshold wait time, e.g. a wait time of less than 10 seconds may be dismissed as likely occurring at a stop sign, or a pattern of traveler movement through the intersection may be identified, e.g. travelers at intersection 209 would be expected to cross the intersection one at a time alternating between a traveler on road 204 and a traveler on road 208, whereas travelers would be expected to cross intersection 205 in waves, with several travelers on road 204 crossing the intersection while travelers on road 206 wait at the intersection. Wait times from intersections determined to be controlled by stop signs, such as intersection 209 controlled by stop signs 218, may be disregarded.

In embodiments, rather than dismissing data from intersections controlled by fixed signals, that data may still be stored and aggregated to determine patterns of wait times at the fixed signal. For example, although the signal itself is fixed, different patterns of traffic throughout the day may cause it to effect route planning differently depending on the time of day. An early morning traveler may pass through an intersection with a fixed signal in less than a minute, whereas travelers during rush hour may require several minutes to pass through the intersection due to traffic accumulating behind the fixed signal.

Intersections controlled by traffic signals, such intersections 205 and 207, may be identified according to map or city planning data, or according to deceleration and wait time data received/calculated from travelers' smart devices. In embodiments, traffic signals not occurring at a crossroads, such as traffic signal 220 on road 206, may also be identified. If a deceleration indication is received and associated geolocation data indicates that it is likely due to interaction with a traffic signal at a crossroad, the system may determine an intersecting traffic signal and draw associated data for comparison, e.g., from a system database or memory, from a related application, from a database associated with the intersecting traffic light, etc. For example, if a deceleration indication is received from a traveler approaching intersection 205 on road 204, the system may determine that the traveler is interacting with traffic signal 210 and that the intersecting traffic signal is traffic signal 212, controlling traffic on road 206. Likewise, if a deceleration indication is received from a traveler approaching intersection 207 on road 206, it may be determined that the traveler is interacting with traffic signal 216, and that the intersecting traffic signal is traffic signal 214, controlling traffic on road 208.

Figure 2B:
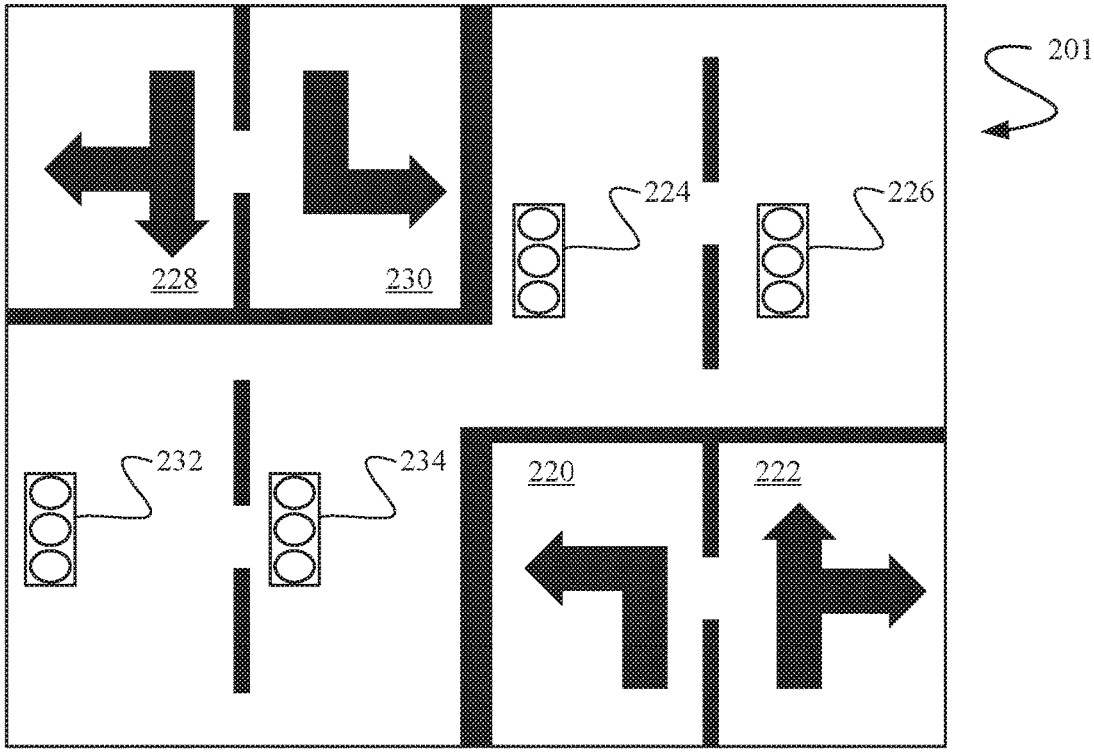
FIG. 2B depicts intersecting traffic signals, according to embodiments of the present disclosure

Referring now to FIG. 2B, intersecting traffic signals are depicted on overhead view 201 of a street, according to embodiments of the present disclosure. In addition to differentiating intersecting traffic signals controlling cross traffic at intersections, as discussed in relation to FIG. 2A, the system may differentiate traffic signals controlling disparate lanes of traffic on a single roadway. For example, in view 201, four parallel lanes of traffic, 220, 222, 228, and 230 are depicted. Each of the four lanes of traffic 220, 222, 228, and 230 are controlled by a distinct traffic signal. Traffic in lanes 222 and 228 either travel straight along the roadway or turn right, exiting the roadway to the "outside" edge and not interacting with other traffic on the roadway. Therefore, the traffic signals controlling traffic in lanes 222 and 228, traffic signals 226 and 232, respectively, do not interact and would not be considered intersecting traffic signals.

Conversely, traffic in lanes 220 and 230 turn left, exiting the roadway to the "inside" edge and interacting with other lanes of traffic in the roadway. Since the traffic in both lane 220 and lane 230 may proceed without interacting, traffic signals 224 and 234 are not intersecting traffic signals. However, since traffic from lane 220 crosses the travel path of lane 228, traffic signals 224 and 232 are intersecting traffic signals. Likewise, traffic signals 234 and 226 are intersecting traffic signals, as traffic from lane 230 crosses the travel path of lane 222 (and vice versa).

Figure 2C:
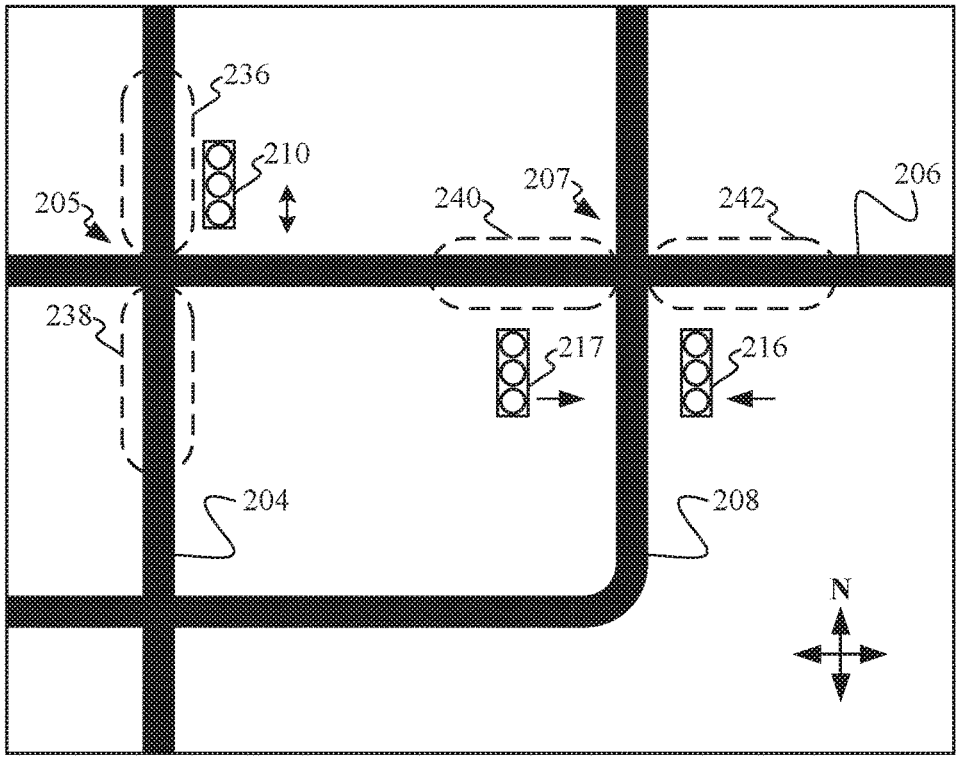
FIG. 2C depicts an example map with traffic signals and their associated areas of influence, according to embodiments of the present disclosure.

Referring now to FIG. 2C, an example map 202 with traffic signals and their associated areas of influence are depicted, according to embodiments of the present disclosure. The map 202 reflects many of the features of map 200, of FIG. 2A, and demonstrates the area of influence of some of the traffic signals. The area of influence may be understood to be the portion of the road approaching traffic interacting with the traffic signal may occupy. For example, traffic signal 210 controls north-south traffic on road 204 at intersection 205. Accordingly, traffic signal 210 has at least two areas of influence: a northside area 236 influencing traffic traveling from north-to-south and a southside area 238 influencing traffic traveling from south-to-north. It may be understood that, in embodiments, traffic signal 210 may represent one or more physical traffic signals. For example, intersection 205 may have a north-facing traffic signal and a south-facing traffic signal, both of these traffic signals controlled by a shared cycle time represented in this example by traffic signal 210. In embodiments, the area of influence may be set as a predetermined parameter, for example a traffic signal may have its area of influence set at 20 meters from the intersection. The area of influence may be determined by the system according to the geolocation and deceleration input received from travelers' smart devices, for example the system may analyze data from a plurality of travelers over time and determine that travelers generally start decelerating within 15 meters of a particular traffic signal. The area of influence may be fixed or adjustable according to new data received by the system.

Some traffic patterns may necessitate traffic moving in different directions on that same road to be subject to different cycle times, for example intersection 207 of map 202 attributes one cycle time, associated with west-facing traffic signal 217, to control traffic traveling east on road 206 and a second cycle time, associated with east-facing traffic signal 216, to control traffic traveling west on road 206. The cycle times between traffic signals 217 and 216 may differ, for example, to accommodate different traffic flows throughout the day or to provide specific opportunities for travelers to make left turns.

Figure 3:
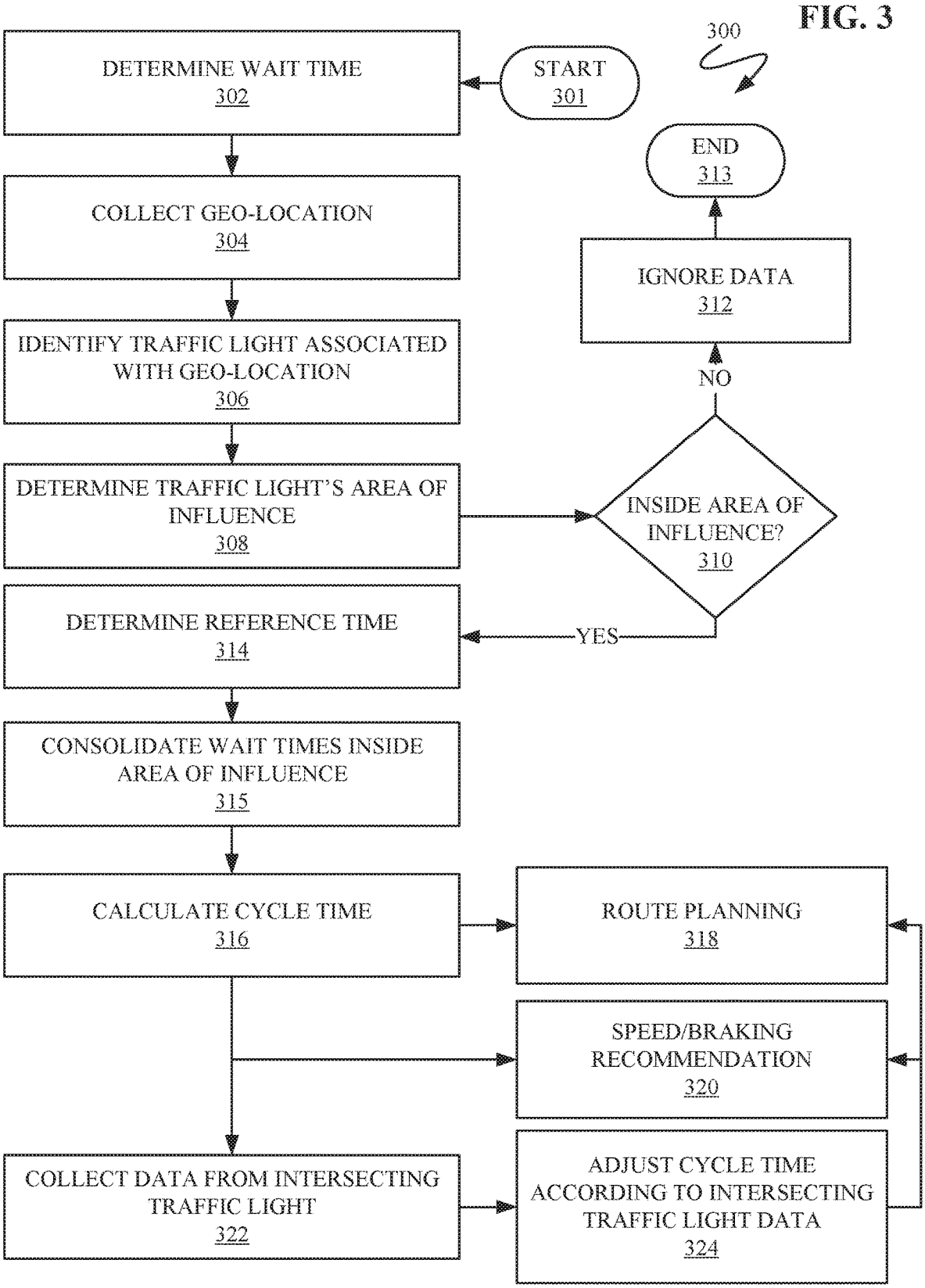
FIG. 3 depicts a flowchart of an example method for calculating and utilizing a traffic signal's cycle time, according to embodiments of the present disclosure.

Referring now to FIG. 3, a flowchart of an example method 300 for calculating and utilizing a traffic signal's cycle time is depicted, according to embodiments of the present disclosure. In embodiments, method 300 may be carried out by one or more processors, integrated with or in communication with one or more travelers' smart devices. The method 300 may be carried out by an application, such as a mapping application, or by a separate system or program. The method 300 begins at operation 301.

At operation 302, a traffic signal's wait time is determined according to a traveler's smart device. In embodiments, the wait time may be determined using the method 100 from FIG. 1.

At operation 304, the traveler's geolocation is determined from the smart device. If a geolocation is not available directly, the device's location may be determined according to other data provided. At operation 306, a traffic signal is identified associated with the traveler's geolocation. In embodiments, cognitive geospatial analysis is used to determine and/or verify the appropriate traffic signal with which the traveler is interacting. Geospatial analysis, or the application of statistical and other analytics to geographical and spatial data, may be used to obtain the direction of streets and avenues and determine or assist in determining the positions of traffic signals and crossroads.

At operation 308, the identified traffic signal's area of influence is determined and, at decision block 310, the geolocation of the received wait time is assessed to determine whether it occurred inside the identified traffic signal's area of influence. If the wait time is determined to have occurred outside the area of influence, the data may be ignored, as at operation 312. If the data is to be dismissed, the method may end, as at operation 313, and proceed to evaluate another wait time or enter a standby state.

If the wait time is determined to have occurred inside the area of influence, an associated reference time may be determined, as at operation 314. The reference time may be set at the start of the cycle, and may generally be defined as the last time the traffic signal transitioned to a "go" signal (typically a green light). The reference time may be determined based on the end of the wait time (a clock time when the counter discussed in relation to FIG. 1 is stopped), according to visual data (e.g., the signal transitions or the waiting traffic begins to move, or may be determined later according to more aggregated data.

The measured wait time may be consolidated with other wait times associated with the traffic signal, at operation 315, and, at operation 316, an average cycle time is calculated for the traffic signal, accounting for the new wait time. In embodiments, each validated wait time associated with a traffic signal may be stored to be used to further refine the traffic signal's cycle time. The cycle time may be calculated taking the average wait time of the consolidated wait times for the traffic signal. The cycle time may further consist of an average movement time, generally taken as the time elapsed between a reference time and when one or more deceleration indications are received. Together the movement time and the wait time may comprise the traffic signal's cycle time, such that from each new reference time, the system may predict how much time travelers will have to move through the traffic signal, as well as the time of the next "stop" signal and the expected wait time.

Following the calculation of the cycle time, the cycle time may be applied in a number of different ways across different platforms and applications. For example, a traffic signal's cycle times could be used by a route planning application, and a new route set or an existing route adjusted according to the calculated cycle time, as at operation 318. In embodiments, the cycle time may be used by a program or application to provide a recommended speed or braking recommendation to a driver to allow them to pass through the approaching intersection before the traffic signal cycles to signal a stop, as at operation 320. The recommendation may be visual, auditory, or otherwise, and may depend on user settings and the route planning or other application used. For example, if the user has set up a route planning application to provide a map with a marked route and spoken word directions, they may see a recommended speed displayed with the route and hear directions to pass through an approaching intersection at a specific speed. The program or application may also notify the driver to expect to stop at the intersection if the traffic signal were predicted to proceed to a stop signal before the traveler could reasonably pass through the intersection.

In embodiments, data from intersecting traffic signals associated with the identified traffic signal may be collected, as at operation 322, and applied to further refine the cycle time calculation, as operation 324. For example, cycle times for a traffic signal may be compared with the intersecting traffic signal's cycle times to verify that intersecting lanes of traffic are not moving at the same time. In embodiments, some intersecting lanes of traffic may receive a move signal at the same time, e.g., two parallel lanes of traffic moving in opposite directions may receive a move signal at the same time and while travelers in these lanes wishing to turn left may move provided they yield to oncoming traffic, and such patterns may be known by the system and accounted for in the comparison in analysis. In order to effectively evaluate more complex traffic patterns, the system may use city planning data and/or cognitive geospatial analysis to identify patterns of traffic flow through traffic signals and accordingly evaluate calculated cycle times.

The adjusted cycle time may then be used for route planning, as at operation 318, speed recommendations, at as operation 320, etc. In embodiments, the wait time may be synced with the data associated with the intersecting traffic signal to determine whether the received wait time matches. For example, if a wait time is determined to be associated with a particular traffic signal, then at least one of one or more intersecting traffic signals associated with the particular traffic signal would be expected.

Figure 4:
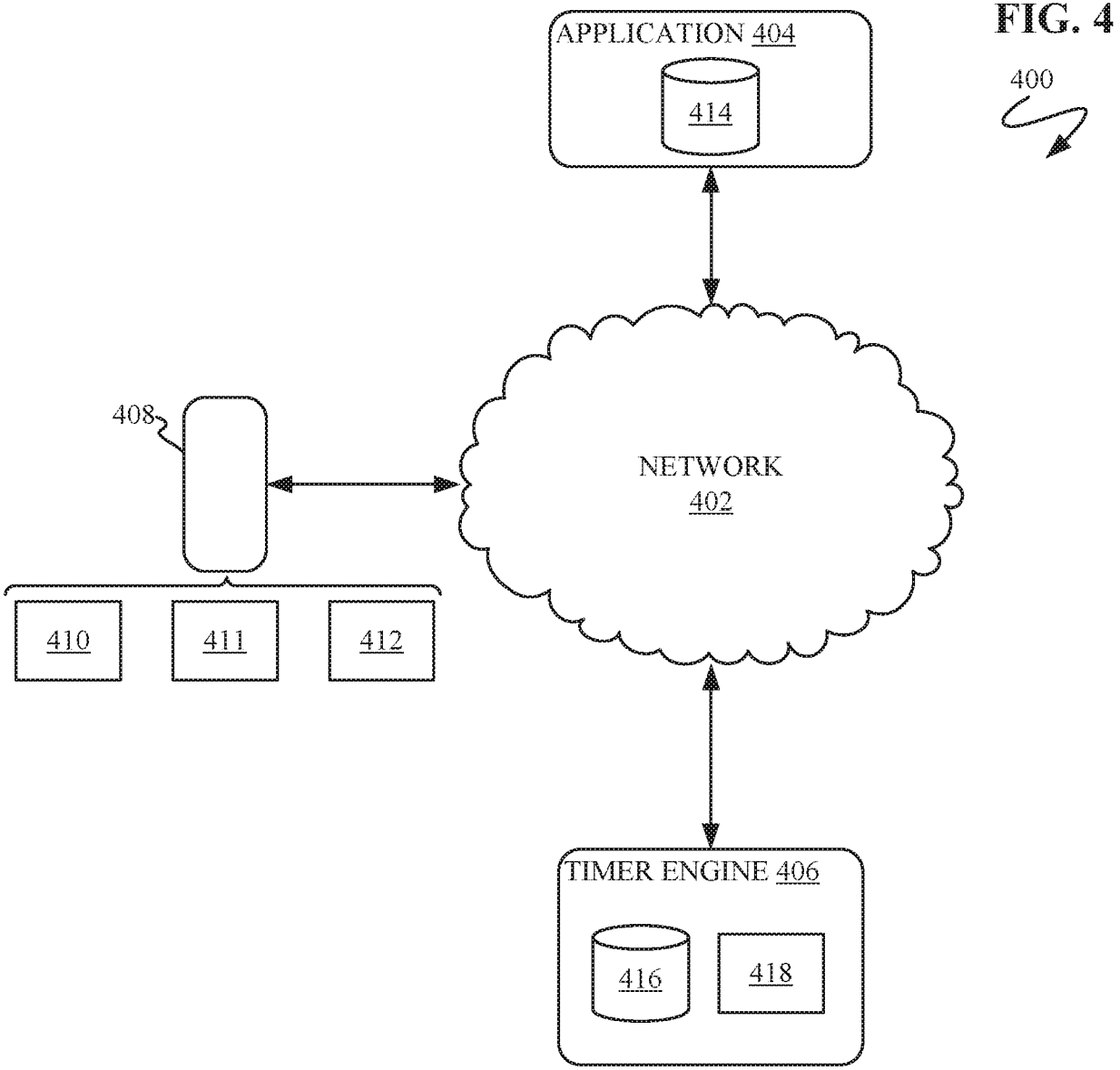
FIG. 4 depicts an example component model for carrying out the disclosed method, according to embodiments of the present disclosure.

Referring now to FIG. 4, an example component model 400 for carrying out the disclosed method is depicted, according to embodiments of the present disclosure. It is to be understood that the depicted organization of disclosed system as networked components as in FIG. 4 is to be non-limiting, as other possible organizations/configurations are possible.

Component model 400 comprises a network 402 facilitating communication between a traffic application 404, a timer engine 406, and a smart device 408. Application 404 may be any existing or to-be-developed traffic or route planning application, or other application utilizing a self-learning timer. Application 404 may incorporate a map database 414, or map database 414 may be a separate database, e.g., accessed via network 402.

Timer engine 406 may incorporate a cycle time database 416 and/or a cognitive geospatial analysis module 418. The engine 406 may use the geospatial analysis module 418 to determine or to verify geoposition data or traffic signal location data received via network 402 from application 404 and/or smart device 408. Cycle time database 416 may comprise one or more tables to organize and track data accumulated and generated.

Cycle time database 416 may comprise a data table, e.g., Table 1 below, for each deceleration indication/wait time received, for example from a smart device 408.

TABLE 1

Example Data Entry Table

| | | |
|---|---|---|
| 1 | Data ID | Unique ID |
| 2 | Traffic Signal ID | ID # |
| 3 | Geolocation Latitude | ##.## degrees |
| 4 | Geolocation Longitude | ##.## degrees |
| 5 | Wait Time | ## (seconds) |
| 6 | Reference Time | ##:## (clock time) |

When the system receives a new data entry, e.g., a deceleration indication, a wait time, etc., a new data table may be generated, beginning with a Data ID, shown in row 1 of Table 1 above, by generating a unique identifier for the new data entry. The unique identifier may generally be an ID number, but may comprise any combination of letters, numbers, symbols, etc. A traffic signal associated with the new data entry, shown in row 2, may then be identified according to geolocation data, shown in rows 3 and 4, received with or associated with the new data entry. If the data is not discarded or ignored, a wait time, shown in row 5, will be associated with the new data entry once measured. A reference time, shown in row 6, is the (clock) time the next cycle begins, in this example being the time the wait time ends and the traffic signal transitions to a move signal. Once a new data entry is verified, it may be used to update a reference table associated with the relevant traffic signal. An example traffic signal reference table, Table 2, is shown below.

TABLE 2

Example Traffic Signal Reference Table

| | | |
|---|---|---|
| 1 | Traffic Signal ID | ID # |
| 2 | Geolocation Latitude | ##.## degrees |
| 3 | Geolocation Longitude | ##.## degrees |
| 4 | Traffic Signal City | City ID (see Table 3, below) |
| 5 | Average Cycle | ## (seconds) |
| 6 | Reference Time | ##:## (clock time) |

A traffic signal reference table may identify the associated traffic signal by a unique identifier, such as an identification number, shown in row 1. This is the same as the identification number used to identify the associated traffic signal in a data entry table (such as Table 1, above). The traffic signal reference table may generally include the traffic signals associated geolocation as latitude, shown in row 3, and longitude, shown in row 4. The particular traffic signal may be further identified by relevant city map data, which may, in embodiments, be accessed via another reference table, such as Table 3 below. A city (state, country, etc.) reference table may be maintained as part of the cycle time database, or maintained separately and accessed via a network or other means data sharing. The traffic signal reference table may be used to store the average cycle time for the particular traffic signal, shown in row 5, and a reference time for the traffic signal, shown in row 6. The traffic signal stored reference time may generally be the most recent verified reference time.

TABLE 3

Example City Map Data Table

| | | |
|---|---|---|
| 1 | City ID | ID # |
| 2 | State ID | ID # |
| 3 | City Description | (string) |

Table 3 depicts an example of stored city (or state, or country, etc.) geography data. The city data table may be identified by an identification number, shown in row 1, and may reference related data tables, e.g. Table 3 references a state related to the subject city by an identification number in row 2. This state ID number may direct to another data table, containing a string of description data concerning the identified state. The table may predominantly consist of a string of description data, as shown in row 3.

Smart device 408 may be any user smart device, such as a mobile phone, tablet, a smart car, watch, etc. Smart device 408 may provide wait time and geoposition data to application 404 and engine 406 via network 402. The network may generally be a wireless network, to support the movement of the smart device according to the traveler's route. The smart device may send and receive communications using any wireless communication protocol, which may be determined by network requirements, user preferences, device limitations, etc.

Smart device 408 may incorporate an accelerometer 410 and a gyroscope 411, as example functionality, by which it may determine a traveler's deceleration/acceleration, whether the traveler is in motion or waiting, etc. Smart device 408 may further incorporate a timer 412 for recording times, e.g., a traveler's wait time at a traffic signal.

Figure 5:
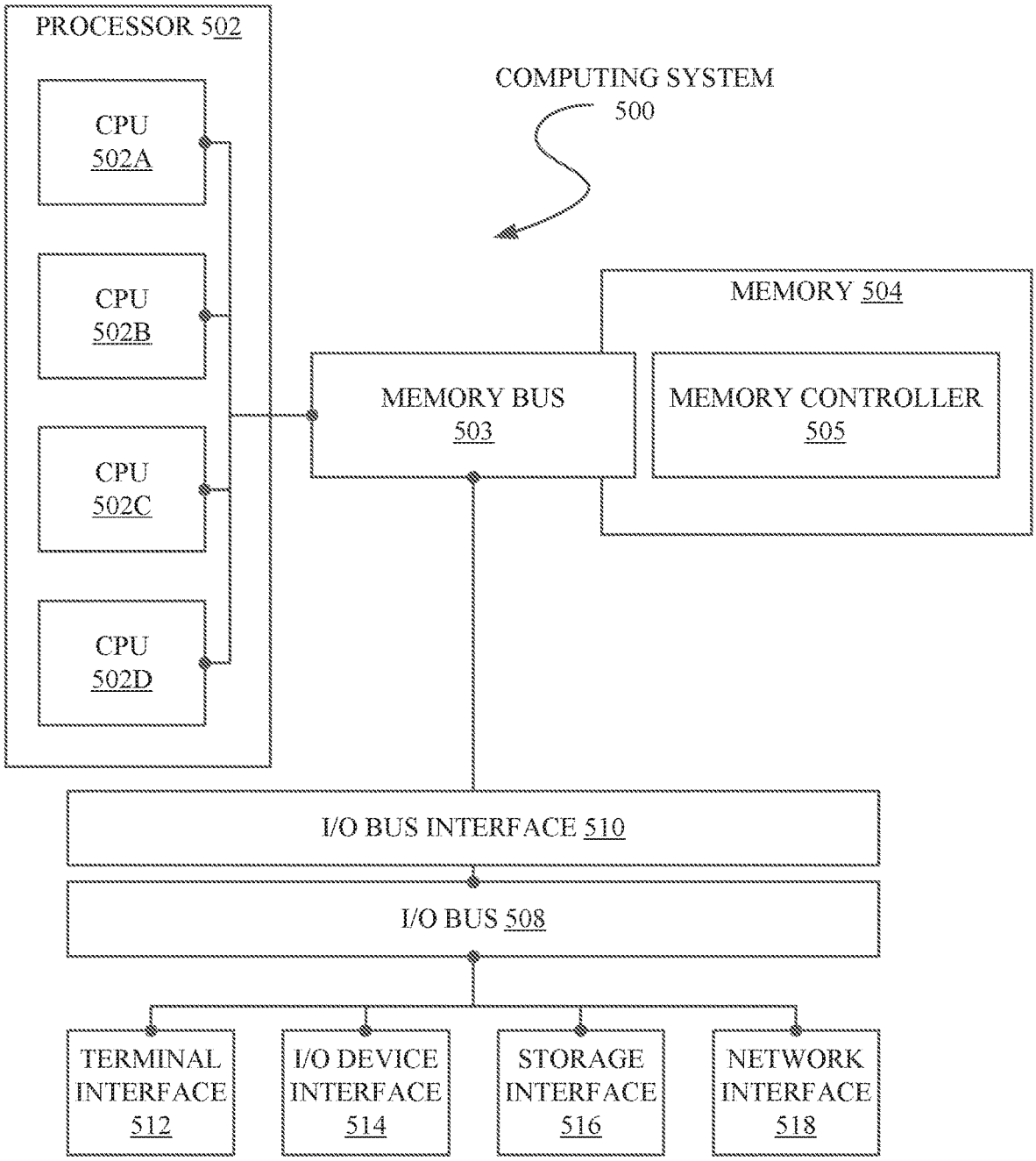
FIG. 5 depicts a high-level block diagram of an example computer that may be used in implementing the methods or modules described herein, according to embodiments of the present disclosure.

Referring now to FIG. 5, shown is a high-level block diagram of an example computer system (i.e., computer) 500 that may be used in implementing one or more of the methods or modules, and any related functions or operations, described herein (e.g., using one or more processor circuits or computer processors of the computer), in accordance with embodiments of the present disclosure. In some embodiments, the major components of the computer system 500 may comprise one or more CPUs 502, a memory subsystem 504, a terminal interface 512, an I/O (Input/Output) device interface 514, a storage interface 516, and a network interface 518, all of which may be communicatively coupled, directly or indirectly, for inter-component communication via a memory bus 503, an I/O bus 508, and an I/O bus interface unit 510.

The computer system 500 may contain one or more general-purpose programmable central processing units (CPUs) 502A, 502B, 502C, and 502D, herein generically referred to as the CPU 502. In some embodiments, the computer system 500 may contain multiple processors typical of a relatively large system; however, in other embodiments the computer system 500 may alternatively be a single CPU system. Each CPU 502 may execute instructions stored in the memory subsystem 504 and may comprise one or more levels of on-board cache.

In some embodiments, the memory subsystem 504 may comprise a random-access semiconductor memory, storage device, or storage medium (either volatile or non-volatile) for storing data and programs. In some embodiments, the memory subsystem 504 may represent the entire virtual memory of the computer system 500, and may also include the virtual memory of other computer systems coupled to the computer system 500 or connected via a network. The memory subsystem 504 may be conceptually a single monolithic entity, but, in some embodiments, the memory subsystem 504 may be a more complex arrangement, such as a hierarchy of caches and other memory devices. For example, memory may exist in multiple levels of caches, and these caches may be further divided by function, so that one cache holds instructions while another holds non-instruction data, which is used by the processor or processors. Memory may be further distributed and associated with different CPUs or sets of CPUs, as is known in any of various so-called non-uniform memory access (NUMA) computer architectures. In some embodiments, the main memory or memory subsystem 504 may contain elements for control and flow of memory used by the CPU 502. This may include a memory controller 505.

Although the memory bus 503 is shown in FIG. 5 as a single bus structure providing a direct communication path among the CPUs 502, the memory subsystem 504, and the I/O bus interface 510, the memory bus 503 may, in some embodiments, comprise multiple different buses or communication paths, which may be arranged in any of various forms, such as point-to-point links in hierarchical, star or web configurations, multiple hierarchical buses, parallel and redundant paths, or any other appropriate type of configuration. Furthermore, while the I/O bus interface 510 and the I/O bus 508 are shown as single respective units, the computer system 500 may, in some embodiments, contain multiple I/O bus interface units 510, multiple I/O buses 508, or both. Further, while multiple I/O interface units are shown, which separate the I/O bus 508 from various communications paths running to the various I/O devices, in other embodiments some or all of the I/O devices may be connected directly to one or more system I/O buses.

In some embodiments, the computer system 500 may be a multi-user mainframe computer system, a single-user system, or a server computer or similar device that has little or no direct user interface, but receives requests from other computer systems (clients). Further, in some embodiments, the computer system 500 may be implemented as a desktop computer, portable computer, laptop or notebook computer, tablet computer, pocket computer, telephone, smart phone, mobile device, or any other appropriate type of electronic device.

It is noted that FIG. 5 is intended to depict the representative major components of an exemplary computer system 500. In some embodiments, however, individual components may have greater or lesser complexity than as represented in FIG. 5, components other than or in addition to those shown in FIG. 5 may be present, and the number, type, and configuration of such components may vary.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A method for a self-learning cycle timer comprising:

determining a wait time, the wait time being a time elapsed between a first indication and a second indication, the first indication associated with a traveler coming to a stop and the second indication associated with the traveler beginning to move following the stop;

identifying a traffic signal associated with a geolocation of the traveler;

determining an area of influence associated with the traffic signal;

determining the wait time occurred inside the area of influence;

identifying an average cycle time and a reference time, each associated with the traffic signal;

calculating a cycle time associated with the traffic signal according to the wait time and the reference time; and updating the average cycle time according to the calculated cycle time.

2. The method of claim 1, further comprising setting a travel route according to the average cycle time.

3. The method of claim 2, further comprising providing a recommended speed for the travel route according to the average cycle time.

4. The method of claim 1, further comprising:

identifying an intersecting traffic signal associated with the geolocation; and retrieving a set of data associated with the intersecting traffic signal.

5. The method of claim 4, further comprising adjusting the average cycle time according to the set of data associated with the intersecting traffic signal.

6. The method of claim 4, further comprising adjusting an intersecting cycle time according the calculated cycle time, wherein the set of data includes the intersecting cycle time.

7. The method of claim 4, further comprising syncing the first indication with the set of data associated with the intersecting traffic signal.

8. The method of claim 7, further comprising:

determining, in response to syncing the first indication with the data associated with the intersecting traffic signal, that the first indication matches the data associated with the intersecting traffic signal; and starting, in response to determining that the first indication matches the data associated with the intersecting traffic signal, a counter to record the wait time.

9. The method of claim 7, further comprising:

determining, in response to syncing the first indication with the data associated with the intersecting traffic signal, that the first indication does not match the data associated with the intersecting traffic signal; and dismissing, in response to determining that the first indication does not match the data associated with the intersecting traffic signal, the first indication.

10. The method of claim 1, further comprising:

comparing the wait time with an average wait time associated with the traffic signal;

determining, in response to comparing the wait time with an average wait time, the wait time is not an outlier; and adjusting, in response to determining the wait time is not an outlier, the average wait time according to the wait time.

11. The method of claim 1, further comprising:

comparing the wait time with an average wait time associated with the traffic signal;

determining, in response to comparing the wait time with an average wait time, the wait time is an outlier; and dismissing, in response to determining the wait time is an outlier, the wait time.

12. A computer system for a self-learning cycle timer, the computer system comprising:

a memory storing an average cycle time and a reference time, each associated with a traffic signal; and a processor in communication with the memory, wherein the computer system is configured to perform a method, the method comprising:

determining a wait time, the wait time being a time elapsed between a first indication and a second indication, the first indication associated with a traveler coming to a stop and the second indication associated with the traveler beginning to move following the stop;

identifying the traffic signal is associated with a geolocation of the traveler;

determining an area of influence associated with the traffic signal;

determining the wait time occurred inside the area of influence;

retrieving, from the memory, the average cycle time and the reference time, each associated with the traffic signal;

calculating a cycle time associated with the traffic signal according to the wait time and the reference time; and updating the average cycle time according to the calculated cycle time.

13. The computer system of claim 12, wherein the method further comprises setting a travel route according to the average cycle time.

14. The computer system of claim 13, wherein the method further comprises providing a recommended speed for the travel route according to the average cycle time.

15. The computer system of claim 12, wherein the method further comprises:

identifying an intersecting traffic signal associated with the geolocation; and retrieving a set of data associated with the intersecting traffic signal.

16. The computer system of claim 15, wherein the method further comprises adjusting the average cycle time according to the set of data associated with the intersecting traffic signal.

17. The computer system of claim 15, wherein the method further comprises adjusting an intersecting cycle time according the calculated cycle time, wherein the set of data includes the intersecting cycle time.

18. A computer program product for a self-learning cycle timer, the computer program product comprising a computer readable storage medium having program instructions embodied therewith, wherein the computer readable storage medium is not a transitory signal per se, the program instructions executable by a processor to perform a method comprising:

determining a wait time, the wait time being a time elapsed between a first indication and a second indication, the first indication associated with a traveler coming to a stop and the second indication associated with the traveler beginning to move following the stop;

identifying a traffic signal associated with a geolocation of the traveler;

determining an area of influence associated with the traffic signal;

determining the wait time occurred inside the area of influence;

identifying an average cycle time and a reference time, each associated with the traffic signal;

calculating a cycle time associated with the traffic signal according to the wait time and the reference time; and updating the average cycle time according to the calculated cycle time.

19. The computer program product of claim 18, wherein the method further comprises:

identifying an intersecting traffic signal associated with the geolocation; and retrieving a set of data associated with the intersecting traffic signal;

syncing the first indication with the set of data associated with the intersecting traffic signal;

determining, in response to syncing the first indication with the data associated with the intersecting traffic signal, that the first indication matches the data associated with the intersecting traffic signal;

starting, in response to determining that the first indication matches the data associated with the intersecting traffic signal, a counter to record the wait time.

20. The computer program product of claim 18, wherein the method further comprises:

comparing the wait time with an average wait time associated with the traffic signal;

determining, in response to comparing the wait time with an average wait time, the wait time is not an outlier; and adjusting, in response to determining the wait time is not an outlier, the average wait time according to the wait time.

* * * * *